US009869479B2

(12) United States Patent
Reinert

(10) Patent No.: US 9,869,479 B2
(45) Date of Patent: Jan. 16, 2018

(54) METHOD FOR PRODUCING A NEAR-SURFACE COOLING PASSAGE IN A THERMALLY HIGHLY STRESSED COMPONENT, AND COMPONENT HAVING SUCH A PASSAGE

(71) Applicant: ALSTOM Technology Ltd, Baden (CH)

(72) Inventor: Felix Reinert, Wettingen (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 782 days.

(21) Appl. No.: 14/445,194

(22) Filed: Jul. 29, 2014

(65) Prior Publication Data

US 2014/0331641 A1 Nov. 13, 2014

Related U.S. Application Data

(63) Continuation of application No. PCT/EP2013/053085, filed on Feb. 15, 2013.

(30) Foreign Application Priority Data

Feb. 17, 2012 (CH) ..... 209/12

(51) Int. Cl.
*F01D 5/18* (2006.01)
*F24F 7/04* (2006.01)
*F28D 7/10* (2006.01)

(52) U.S. Cl.
CPC ..... *F24F 7/04* (2013.01); *F01D 5/187* (2013.01); *F28D 7/10* (2013.01); *F05D 2230/12* (2013.01);
(Continued)

(58) Field of Classification Search
CPC .... F24F 7/04; F28D 7/10; F01D 5/187; F01D 5/18; F01D 5/188; F01D 5/189;
(Continued)

(56) References Cited

U.S. PATENT DOCUMENTS 1,473,827 A 11/1923 Mills
1,841,762 A 1/1932 Samesreuther et al.
(Continued)

FOREIGN PATENT DOCUMENTS

CN 1445081 A 10/2003
CN 1816646 A 8/2006
(Continued)

OTHER PUBLICATIONS

Office Action (Notice of Reasons for Refusal) dated Nov. 14, 2016, by the Japanese Patent Office in Japanese Patent Application No. 2014-557054, and an English Translation of the Office Action. (12 pages).

*Primary Examiner* — Gregory Anderson
*Assistant Examiner* — Eldon Brockman
(74) *Attorney, Agent, or Firm* — Buchanan Ingersoll & Rooney PC

(57) ABSTRACT

The invention refers to a method for producing a near-surface cooling passage in a thermally highly stressed component, which includes: a) providing a component which has a surface on a hot side in a region which is to be cooled; b) letting a channel into the surface; c) inserting a cooling tube into the channel; d) filling the channel, with the cooling tube inserted, with a temperature-resistant filling material in such a way that the inserted cooling tube is embedded into the filling material, leaving free an inlet and an outlet; and e) covering the channel, with the cooling tube embedded, with an anti-oxidation, temperature-stable cover layer. The method is inexpensive and can be used in a flexible manner
(Continued)

in the most diverse situations in order to save cooling medium or to reduce the thermal load.

18 Claims, 5 Drawing Sheets

(52) U.S. Cl.
CPC .. *F05D 2240/121* (2013.01); *F05D 2240/303* (2013.01); *F05D 2240/81* (2013.01); *F05D 2260/202* (2013.01); *F05D 2260/204* (2013.01); *Y10T 29/49229* (2015.01)

(58) Field of Classification Search
CPC ..... F05D 2260/204; F05D 2240/121; F05D 2240/303; F05D 2240/81; F05D 2230/12; F05D 2260/202; B23K 2201/001; B23P 6/002; B23P 6/045; B23P 15/02; B23P 15/04; B23P 2700/06
See application file for complete search history.

(56) References Cited

U.S. PATENT DOCUMENTS 2,687,278 A 8/1954 Smith et al.
2,811,761 A 11/1957 Bauer
4,156,582 A * 5/1979 Anderson ..... F01D 5/185 416/92
4,183,456 A * 1/1980 Schilling ..... B23K 20/14 228/175
4,185,369 A 1/1980 Darrow et al.
4,249,291 A * 2/1981 Grondahl ..... B23P 15/04 228/126
4,259,037 A * 3/1981 Anderson ..... F01D 5/185 416/92
4,350,473 A 9/1982 Dakin
4,977,955 A 12/1990 Schweizer
5,271,457 A 12/1993 Ganz
6,214,248 B1 4/2001 Browning et al.
6,383,602 B1 * 5/2002 Fric ..... F01D 5/186 415/115
7,658,590 B1 2/2010 Spanks
7,744,348 B2 * 6/2010 Bezencon ..... B23P 15/02 416/241 R
7,854,122 B2 * 12/2010 Steele ..... F01D 25/12 60/752
8,210,815 B2 7/2012 Bezencon et al.
8,528,208 B2 * 9/2013 Rebak ..... F01D 5/147 29/889.72
8,601,691 B2 * 12/2013 Rebak ..... F01D 5/184 205/80
2001/0007708 A1 * 7/2001 Venkataramani ..... B05D 1/32 428/139
2007/0036942 A1 * 2/2007 Steele ..... F01D 25/12 428/131
2007/0253817 A1 11/2007 Bezencon et al.
2010/0080688 A1 4/2010 Bezencon et al.
2012/0114912 A1 * 5/2012 Bunker ..... C23C 4/02 428/173
2012/0243995 A1 * 9/2012 Bunker ..... F01D 5/18 416/95

FOREIGN PATENT DOCUMENTS

CN 101899662 A 12/2010
EP 1 211 385 A2 6/2002
EP 1 813 775 A2 8/2007
EP 2 381 070 A2 10/2011
FR 2 476 744 A1 8/1981
JP S5374613 A 7/1978
JP S53137317 A 11/1978
JP S5612001 A 2/1981
JP S56135701 A 10/1981
JP 2008525698 A 7/2008
WO 2008/100306 A2 8/2008

* cited by examiner

METHOD FOR PRODUCING A NEAR-SURFACE COOLING PASSAGE IN A THERMALLY HIGHLY STRESSED COMPONENT, AND COMPONENT HAVING SUCH A PASSAGE

CROSS-REFERENCE TO RELATED APPLICATIONS

This application claims priority to PCT/EP2013/053085 filed Feb. 15, 2013, which claims priority to Swiss application 00209/12 filed Feb. 17, 2012, both of which are hereby incorporated in their entireties.

TECHNICAL FIELD

The present invention relates to the field of thermal machines. It refers to a method for producing a near-surface cooling passage in a thermally highly stressed component according to the preamble of claim 1. It also refers to a component which is produced according to the method.

BACKGROUND

In thermal machines, efficiency which is as high as possible has always been the target in order to use the applied fuels more effectively for power generation. In the case of gas turbines, the aim is an efficiency of 63%, for example, for which higher combustion temperatures in the region of 1850K would be required. In order to achieve this, thermally highly loaded components of the machine have to be cooled by means of complex cooling devices and configurations. On account of the increasing complexity, problems in the production of such components increase and lead to high scrap rates.

In the case of gas turbines, on account of an irregular profile of the combustion chamber exit temperature, critical hot zones in the subsequently arranged components, such as stator blades or rotor blades or wall elements of the hot gas passage, occur, resulting in local overheating so that in such components working temperatures which are approximately 80-130K higher than the hot gas temperature are to be taken into consideration in the future.

For this reason, very efficient local cooling of the thermally highly loaded components is required in the case of gas turbines and comparable thermal machines.

One possible way, in which such efficient local cooling can be developed, is near-surface or near-wall cooling which is shown in two variants in FIGS. 1 and 2. The component 10' (tubular in the example) from FIG. 1 has a wall 11 with a thickness t which is 4 mm, for example. Hot gas impinges upon the component 10' from the outside (block arrow). Cooling medium, mostly air or steam, flows through the interior space 12 of the component 10' and at least partially dissipates the externally introduced heat from the wall 11.

An improved alternative cooling configuration is reproduced in FIG. 2 for the component 10. In this case, parallel cooling passages 13, through which flows cooling medium, with an inside diameter d1 of 1 mm, for example, extend directly in the wall 11 and are only at a distance d2 of 0.5 mm, for example, from the outer surface of the wall 11.

A transition from the configuration in FIG. 1 to the configuration of FIG. 2 enables a reduction of the cooling medium mass flow by 40-55%, or an increase of the hot gas temperatures by 50-125K, on account of the reduced distance between cooling medium and hot gas.

Such a configuration can be achieved in components with effusion cooling in the following way: the basis is a component which according to FIG. 3 has an effusion-cooled component wall 14' (with a thickness of 2.0 mm-5.3 mm, for example) through which oblique cooling holes 15 (with an inside diameter of 0.8 mm, for example) extend from a cool side CS of the component wall 14' to a hot side HS, through which cooling holes cooling medium 16 flows and discharges on the thermally loaded surface 18.

In the case of a component according to FIG. 4 with a comparable wall 14, instead of cooling holes 15 cooling passages 17 are formed in the component wall 14 and with an inside diameter of 1.0 mm, for example, comprise a plurality of sections 17*a*, 17*b* and 17*c*. The first passage section 17*a* extends from the inlet on the cool side CS into the interior of the component wall 14. A second passage section 17*b* adjoins the first passage section 17*a* and (in the manner of the cooling passages 13 in FIG. 2) extends essentially parallel (at a distance of 0.6 mm, for example) to the surface 18 which is to be cooled. A third passage section 17*c* then adjoins the second cooling passage 17*b* and terminates in an outlet on the hot side HS. The first passage section 17*a* and the third passage section 17*c* are oriented obliquely to the surface 18 in this case (similar to the cooling holes 15 in FIG. 3).

A cooling configuration of the type shown in FIG. 4, as near-surface or near-wall cooling, would bring significant advantages compared with conventional cooling configurations.

Such a cooling configuration, however, poses problems with regard to the difficulties related to production engineering, which lead to high costs and high scrap rates.

It is certainly conceivable to realize such cooling configurations by casting methods in the hollow core technique. In this case, after the casting of the component the core forming the network of internal cooling passages is removed. The remaining cavities form the passages. Although this method is practical as regards production engineering, it is expensive owing to the complexity and is afflicted with high scrap rates. Furthermore, a component cannot be reworked with this technology or be subsequently altered.

SUMMARY

It is therefore an object of the invention to disclose a method for producing near-surface cooling passages for thermally loaded components of a thermal machine, especially of a gas turbine, which method can be applied to different components and is to be carried out at comparatively low cost and with a low scrap rate, even in retrospect on already existing components, and provides components with significantly improved cooling effect and correspondingly increased service life.

It is also an object of the invention to disclose a corresponding component.

These and other objects are achieved by the total features of claims 1 and 13.

The method according to the invention for producing a near-surface cooling passage in a thermally highly stressed component comprises the following steps:

a) providing a component which has a surface on a hot side in a region which is to be cooled;
b) letting at least one channel into this surface;
c) inserting a cooling tube into the channel;
d) filling the channel, with the cooling tube inserted, with a temperature-resistant filling material in such a way that the inserted cooling tube is embedded into the filling material, leaving free an inlet and an outlet; and e) covering the channel, with the cooling tube embedded, with an anti-oxidation, temperature-stable cover layer.

One embodiment of the method according to the invention is characterized in that in step (b) the channel in the component is hollowed out by means of a material-removing process.

In this case, the channel can especially be hollowed out in the component by spark erosion by means of an EDM electrode.

The EDM electrode in its shape preferably corresponds to the channel which is to be hollowed out.

Another embodiment of the method according to the invention is characterized in that the component has a wall with a hot side and an oppositely disposed cool side, and in that the channel is introduced into the component wall in such a way that it extends through the wall from the cool side towards the hot side and has an inlet on the cool side and an outlet on the hot side.

It is especially favorable in this case if the channel, and consequently also the finished cooling passage, comprise a first passage section which extends from the inlet on the cool side into the interior of the component wall, a second passage section which adjoins the first passage section and extends essentially parallel to the surface which is to be cooled, and a third passage section which adjoins the second passage section and terminates in the outlet on the hot side.

The first cooling passage and the third cooling passage are preferably oriented obliquely to the surface, that is to say at an acute angle.

In this case, the cooling passage can especially have an inside diameter of approximately 1 mm and the second passage section can be at a distance which is less than or equal to 1 mm from the surface which is to be cooled. A further embodiment of the method according to the invention is characterized in that the channel is let into the component to such a depth, or hollowed out from the component to such a depth, that the inserted cooling tube, apart from inlet and outlet, is located well below the surface.

Another embodiment of the method according to the invention is characterized in that the channel, with the cooling tube inserted, is filled with a high-temperature solder as filling material.

Yet another embodiment of the method according to the invention is characterized in that the anti-oxidation, temperature-stable cover layer is applied by deposition welding by means of a laser metal forming process (LMF). In this case, the cover layer is preferably formed by consecutive application of a plurality of overlapping coatings.

Thermal spraying constitutes an alternative preferred coating process.

The thermally highly stressed component according to the invention, having a hot side delimited by a surface and at least one near-surface cooling passage, is characterized in that the cooling passage is produced by a method according to the invention.

One embodiment of the component according to the invention is characterized in that the component has a wall with a hot side and an oppositely disposed cool side, and in that the cooling passage extends through the component wall from the cool side to the hot side and has an inlet on the cool side and an outlet on the hot side.

Another embodiment of the component according to the invention is characterized in that the cooling passage comprises a first passage section which extends from the inlet on the cool side into the interior of the component wall, a second passage section which adjoins the first passage section and extends essentially parallel to the surface which is to be cooled, and a third passage section which adjoins the second passage section and terminates in the outlet on the hot side.

The first passage section and the third passage section are especially oriented obliquely to the surface and preferably include an angle of between 15° and 30°, especially preferably an angle of approximately 18°, with the surface normal.

A further embodiment of the component according to the invention is characterized in that the cooling passage has a cooling tube which lies in a channel let into the surface and is embedded into a temperature-resistant filling material, especially a high-temperature solder.

The cooling tube preferably has an inside diameter of approximately 1 mm and an outside diameter of approximately 1.5 mm, and the second passage section is at a distance which is less than or equal to 1 mm from the surface which is to be cooled.

Another embodiment of the component according to the invention is characterized in that the cooling passage has a length of approximately 20 mm.

Yet another embodiment of the component according to the invention is characterized in that a plurality of cooling passages are arranged in the component in parallel and/or in series and at a distance from each other. In this case, cooling medium can flow through the plurality of cooling passages in the same or opposite directions.

Other cooling arrangements, with differently oriented or dimensioned cooling passages, which are optimally adapted to the cooling requirements of the component, are also conceivable.

BRIEF DESCRIPTION OF THE DRAWINGS

The invention shall subsequently be explained in more detail based on exemplary embodiments in conjunction with the drawing. In the drawing

DETAILED DESCRIPTION

The invention discloses a new alternative to already known production methods for near-surface cooling configurations. Instead of attempting to form corresponding cooling passages in the base material or to form cooling passages by the combination of two or more parts, the subsequently explained solution for producing near-surface or near-wall cooling passages is based on the embedding of complete passages into the surface of the component.

A sequence of production steps for this method comprises the following: in a first step, the base material is prepared in a suitable manner, especially by hollowing out a channel, in order to accommodate a tube which is later let into the surface. The configuration of such a channel can be straight, but other configurations, such as meander configurations, are also conceivable in order to optimize the cooling effect in a specific manner depending upon the application case.

Figure 7:
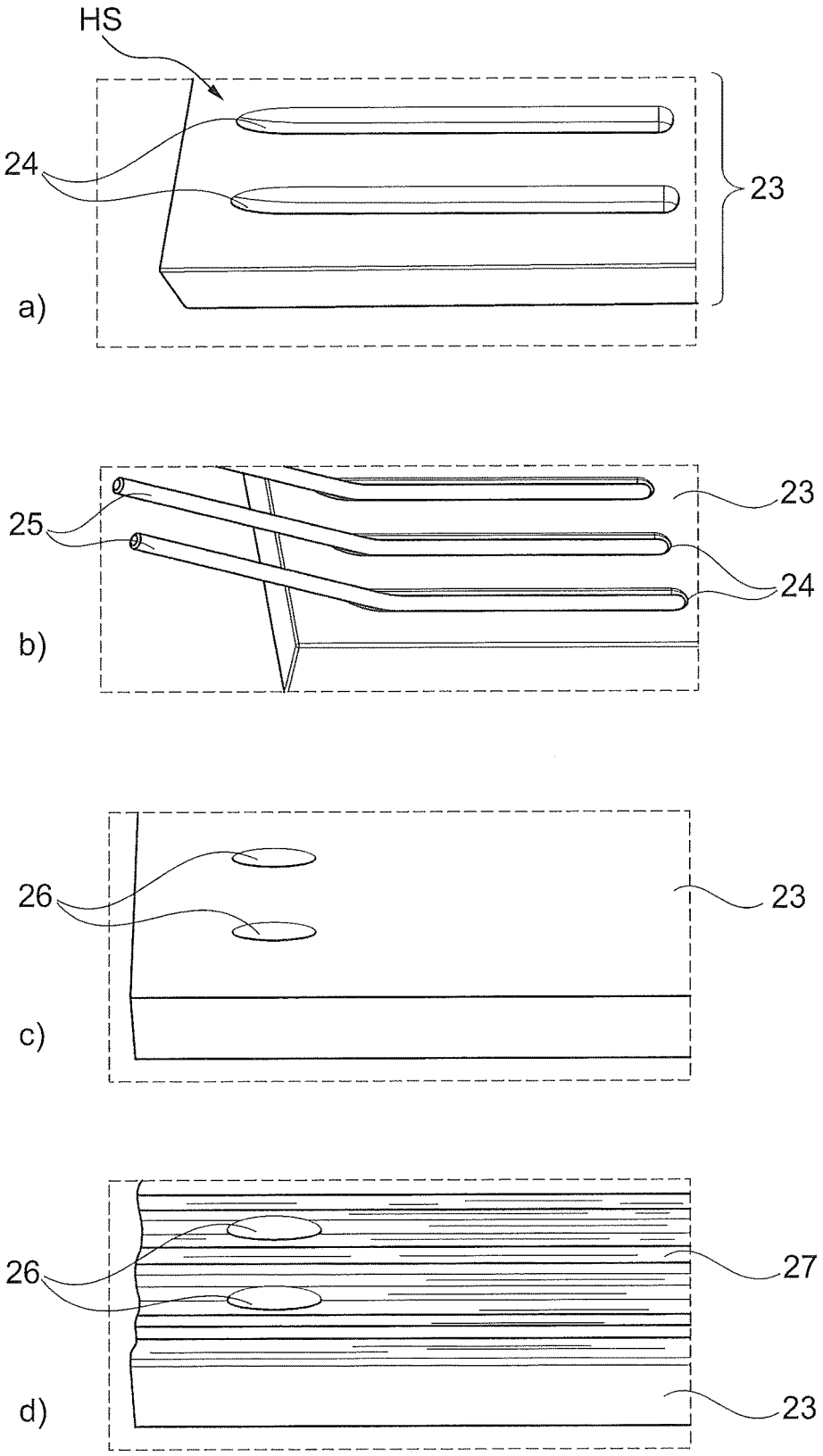
FIG. 7 shows in a photographic representation various steps for producing near-surface cooling passages in a plate-like component, according an exemplary embodiment of the invention.

The channels are usually introduced into the component or into the wall from the hot gas side or hot side (see FIG. 7 (*a*)). It is also conceivable, however, to introduce the channels from the other side if this location is accessible for the machine being used. In parallel with the introduction of the channel(s), passage inserts in the form of closed bodies, preferably in the form of tubes with an inside diameter of approximately 1 mm and outside diameters of between 1.5 mm and 2.5 mm, are prefabricated. A round cross-sectional shape assists in minimizing crack development.

The tubes are then introduced into the channels in the component or in the component wall which is to be cooled (see FIGS. 7 (*b*) and 10). The introduction of closed forms, such as tubes, ensures stabilization of the molten pool during the later deposition welding of the cover layer.

For fixing the tubes in the channel and for achieving an optimum heat transfer, the tubes are embedded into a filling material, especially in the form of a high-temperature solder, in the channel and the surface is smoothed off by means of grinding (see FIG. 7 (*c*)).

Finally, an anti-oxidation cover layer is applied by means of laser metal forming (LMF) or by means another coating process (see FIGS. 7(*d*) and 11). For final thermal insulation, a thermal barrier coating (TBC) can also be applied on top of it.

The ends of the inserted tubes form an inlet and an outlet for the through-flowing cooling air. It is of great importance, therefore, that these openings are not closed off or constricted during the embedding with high-temperature solder.

Figure 1:
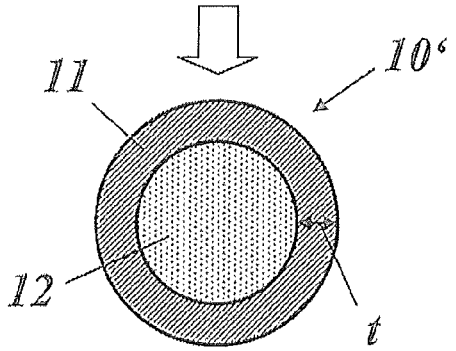
FIG. 1 shows in cross section a tubular component in which the thermally loaded wall is cooled by means of cooling medium flowing inside the tube.
Figure 2:
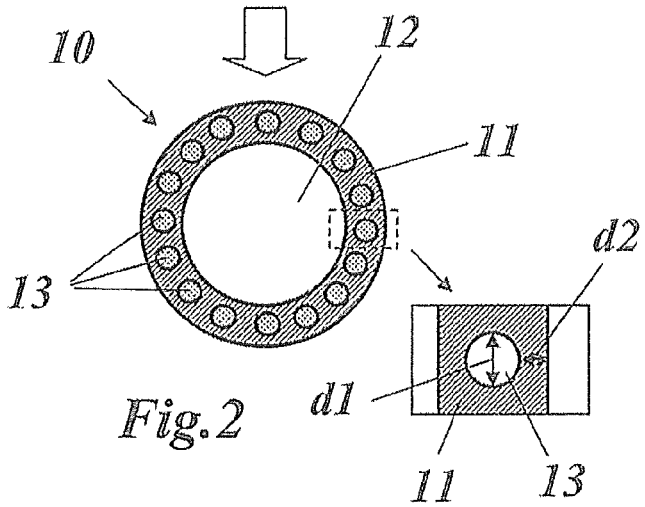
FIG. 2 shows in cross section and in an enlarged detail a tubular component in which the thermally loaded wall is cooled close to the surface by means of cooling passages extending inside the wall.
Figure 3:
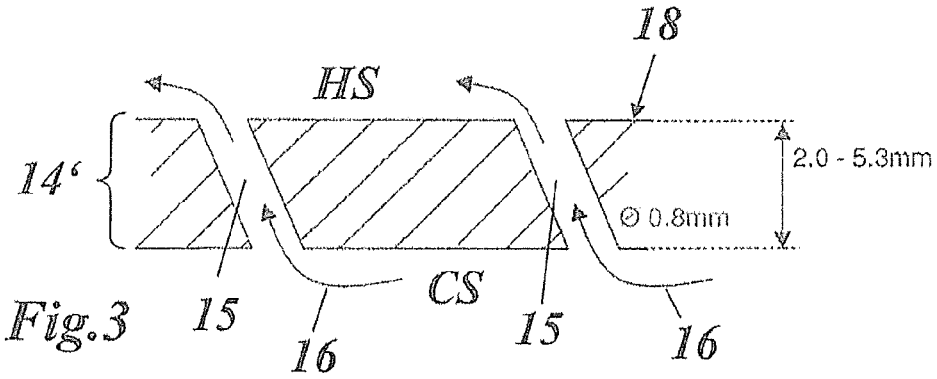
FIG. 3 shows the section through a component wall with cooling passages for conventional effusion cooling.
Figure 4:
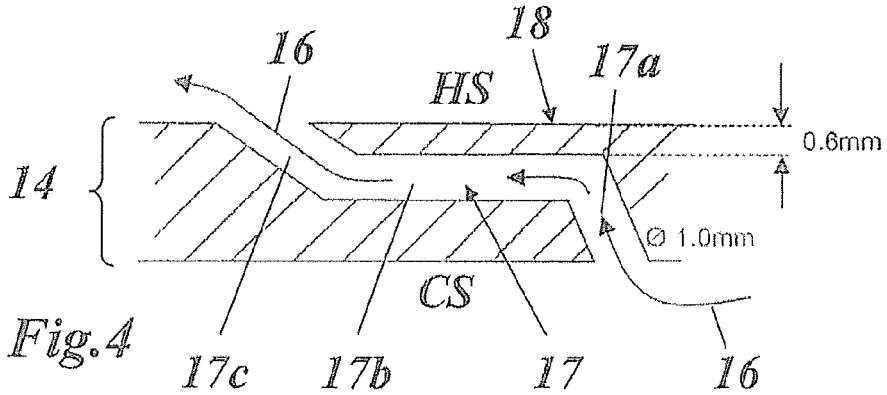
FIG. 4 shows in a view comparable to FIG. 3 a component wall with near-surface cooling passages in addition to effusion cooling.
Figure 6:
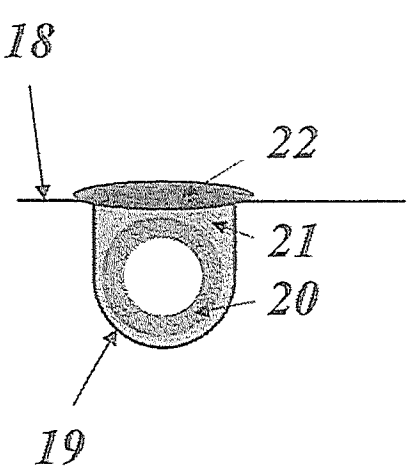
FIG. 6 shows the section through a cooling passage from FIG. 5 in the plane VI-VI.
Figure 5:
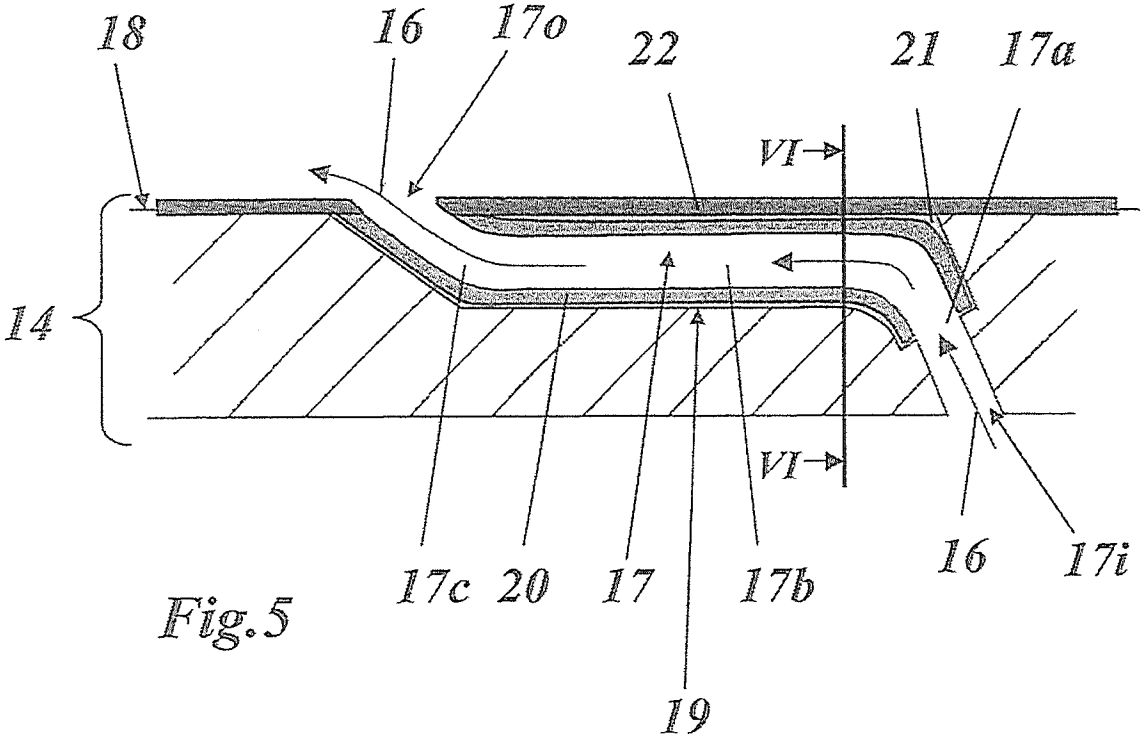
FIG. 5 shows in a view comparable to FIG. 4 a component wall with near-surface cooling passages, according to an exemplary embodiment of the invention.

In a view comparable to FIG. 4, FIG. 5 shows a component wall with near-surface cooling air passages according to an exemplary embodiment of the invention. FIG. 6 shows the section through a cooling passage from FIG. 5 in the plane VI-VI. A cooling passage 17, which comprises a plurality of sections 17*a*, 17*b* and 17*c*, extends through the component wall 14 of FIG. 5, and cooling medium 16, for example cooling air 16, flows through the cooling passage during operation from an inlet 17*i* on the cool side to an outlet 17*o* on the hot side and discharges there on the thermally loaded surface 18.

The cooling passage 17 is formed essentially by a cooling tube 20 which is inserted into a channel 19 introduced into the component wall 14 and embedded there into a filling material 21 consisting of high-temperature solder. A cover layer 22 consisting of oxidation-resistant material is applied on top of the (smoothed) layer of filling material 21 by means of LMF. The cross section of the arrangement is reproduced in FIG. 6. The round cross-sectional geometry of the tube 20 is less susceptible to crack development.

The cooling passage 17 does not have any undercuts. The inside diameter of the cooling tube 20 is, for example, 1.0 mm and the outside diameter is 1.5 mm. The center passage section 17*b* extends parallel to the surface 18, whereas the passage sections 17*a* and 17*c* are oriented obliquely to the surface normal by an angle of approximately 18°. The length of the cooling passage 17 is approximately 20 mm. The depth of the channel 19 in the center passage section 17*b* is approximately 1.6 mm. The tube 20 extends at least over the center passage section 17*b* and the passage section 17*c* on the hot side, as shown in FIG. 5. It can also extend, however, over a part of, or the entirety of, the passage section 17*a* on the cold side.

FIG. 7 shows in a photographic representation various steps (a) to (e) for producing near-surface cooling passages in a plate-form component according to exemplary embodiments of the invention. FIG. 7(*a*) shows the channels 24 or 29 which are introduced into the components 23 or 28 by means of EDM. Correspondingly formed cooling tubes 25 or 30 are then introduced (inserted) into these channels 24, 29 according to FIG. 7(*b*). The inserted tubes are then embedded into high-temperature solder according to FIG. 7(*c*) and the surface in the region of the filled channels is ground smooth. The remaining outlets 26 or 31 of the cooling passages are clearly visible. Finally, an oxidation-resistant cover layer 27 or 32 consisting of suitable material is applied in overlapping widths by means of LMF according to FIG. 7(*d*).

Figure 8:
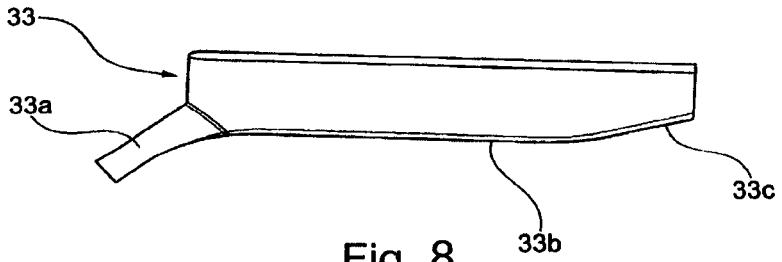
FIG. 8 shows in a perspective side view an example of an EDM electrode which can be used in the invention.
Figure 9:
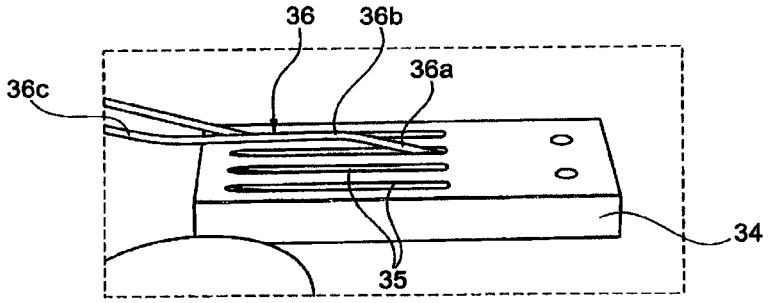
FIG. 9 shows the inserting of correspondingly bent tubes into the channels which have been hollowed out in the component, according to another exemplary embodiment of the invention.

For introducing the channels (19 in FIGS. 5, 6) into the surface of the component, use is made of an EDM electrode 33 according to FIG. 8, having a plurality of electrode sections 33*a-c* which correspond to the subsequent passage sections 17*a-c*. With such an electrode, the channels are hollowed out by means of countersink erosion. In conformance with the configuration of the channels 35, comprising three sections, in a component 34, the cooling tubes 36 which are to be inserted are also divided into three sections 36*a-c* according to FIG. 9.

Figure 10:
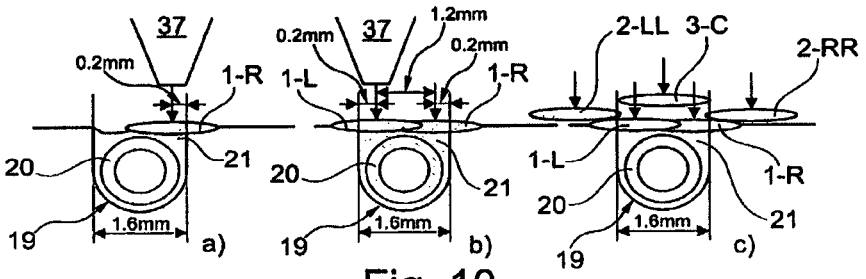
FIG. 10 shows in a view comparable to FIG. 6 a plurality of steps during the production of the cover layer by means of deposition welding (LMF), according to another exemplary embodiment of the invention.

The application of the cover layer 22 by means of LMF is carried out according to FIG. 10 preferably by overlapping, consecutive application of cover layer coatings 1-R to 3-C. In a first step (FIG. 10(*a*)), a first right-hand cover layer coating 1-R is applied. In a second step (FIG. 10(*b*)), a first left-hand cover layer coating 1-L is applied in an overlapping manner. In further steps (FIG. 10(*c*)), further right-hand and left-hand cover layer coatings 2-RR and 2-LL and a third central cover layer coating 3-C are then applied.

Figure 11:
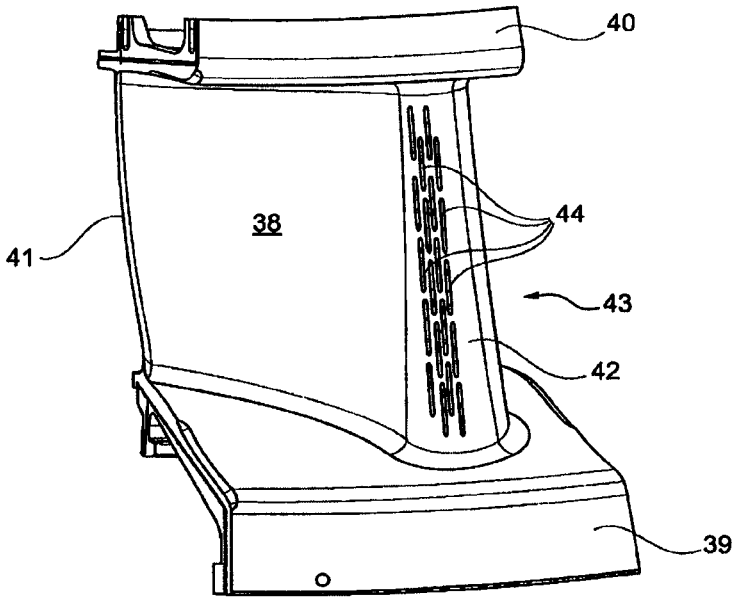
FIG. 11 shows an exemplary embodiment for a component according to the invention in the form of a stator blade with cooling passages introduced into the leading edge of the blade airfoil, according to the invention.

As an exemplary embodiment of a component according to the invention, FIG. 11 finally shows a stator blade 43 of a gas turbine, which stator blade has a cooled blade airfoil 38 between a lower platform 39 and an upper platform 40, the blade airfoil having a trailing edge 41 and leading edge 42. In the leading edge 42, instead of simple effusion cooling holes, parallel cooling passages 44, which are offset in relation to each other in a plurality of rows, are arranged according to the invention. With regard to the flow direction of the cooling medium, in this case the cooling passages 44 of adjacent rows, also such a row itself, can be differently oriented corresponding to the requirements of the specific individual case. As a result of this, some of the cooling medium flowing through the blade can be saved with cooling remaining constant.

Overall, using the method according to the invention a near-surface or near-wall cooling passage of any shape can be arranged on any customarily convection-cooled hot gas surface in order to improve the cooling effect and to save cooling medium. If necessary, larger surfaces can also be equipped with such cooling passages. The described technology can also be applied if a component has to be reconditioned or if an existing component has to be improved or replaced.

The invention has a number of advantages:

The near-wall cooling system can be used locally in hot zones;

It can be introduced from the hot outer side;

Already installed components can be reworked (retrofit);

The production method enables reconditioning of used components;

The high cooling effect reduces the consumption of cooling medium;

Under certain conditions, the hot gas temperature in the machine can be increased;

The method is a favorable alternative to double-wall casting; and

The shape of the introduced cooling passages minimizes the risk of crack development.

The invention claimed is:

1. A method for producing a near-surface cooling passage in a thermally highly stressed component, the method comprising:

a) providing a component which has a surface configured to face a hot side in a region which is to be cooled and a surface configured to face a cool side in the region to be cooled;

b) forming a channel into the surfaces to extend from the cool side to the hot side with a cooling medium inlet on the cool side and a cooling medium outlet on the hot side and including a first passage section extending from the cooling medium inlet on the cool side into an interior of the component, a second passage section adjoining the first passage section and extending essentially parallel to the surface which is to be cooled, and a third passage section adjoining the second passage section and terminating in the cooling medium outlet on the hot side;

c) inserting a cooling tube into the channel;

d) filling the channel, with the cooling tube inserted, with a temperature-resistant filling material in such a way that the inserted cooling tube is embedded into the filling material, leaving free an inlet and an outlet; and e) covering the channel, with the cooling tube embedded, with an anti-oxidation, temperature-stable cover layer.

2. The method as claimed in claim 1, comprising:

forming the channel by hollowing out the component by a material-removing process.

3. The method as claimed in claim 2, comprising:

forming the channel by hollowing out the component by spark erosion by using an EDM electrode.

4. The method as claimed in claim 3, wherein the EDM electrode has a shape that corresponds to the channel which is to be hollowed out.

5. The method as claimed in claim 1, wherein the first passage section and the third passage section are oriented obliquely to the surface at an acute angle.

6. The method as claimed in claim 1, wherein the cooling passage has an inside diameter of approximately 1 mm and the second passage section is at a distance which is less than or equal to 1 mm from the surface which is to be cooled.

7. The method as claimed in claim 1, wherein the channel is formed into the component to such a depth, or hollowed out of the component to such a depth, that the inserted cooling tube, apart from the inlet and the outlet, is located below the surface.

8. The method as claimed in claim 1, wherein the channel, with the cooling tube inserted, is filled with a high-temperature solder as filling material.

9. The method as claimed in claim 1, comprising:

applying the anti-oxidation, temperature-stable cover layer by deposition welding using a laser metal forming process.

10. The method as claimed in claim 9, comprising:

forming the cover layer by consecutive application of a plurality of overlapping cover layer coatings.

11. A component configured to be subject to thermally high stresses, comprising:

a surface configured to face a hot side in a region which is to be cooled;

a surface configured to face a cool side in the region to be cooled;

a channel formed into the surfaces and extending from the cool side to the hot side with a cooling medium inlet on the cool side and a cooling medium outlet on the hot side and including a first passage section extending from the cooling medium inlet on the cool side into an interior of the component, a second passage section adjoining the first passage section and extending essentially parallel to the surface which is to be cooled, and a third passage section adjoining the second passage section and terminating in the cooling medium outlet on the hot side;

a cooling tube arranged in the channel;

a temperature-resident filling material, wherein the cooling tube is embedded into the filling material, an anti-oxidation, temperature-stable cover layer covering the channel.

12. The component as claimed in claim 11, wherein the first passage section and the third passage section are oriented obliquely to the surface, that is to say at an acute angle, and include an angle of between 15° and 30°, with the surface normal.

13. The component as claimed in claim 12, wherein the angle is approximately 18° with the surface normal.

14. The component as claimed in claim 11, wherein the cooling tube lies in the channel formed into the surface and is embedded into the temperature resistant filling material.

15. The component as claimed in claim 14, wherein the cooling tube has an inside diameter of approximately 1 mm and an outside diameter of approximately 1.5 mm, and in that the second passage section is at a distance which is less than or equal to 1 mm from the surface which is to be cooled.

16. The component as claimed in claim 14, wherein the temperature-resistant filling material is a high-temperature solder.

17. The component as claimed in claim 11, wherein the cooling passage has a length of approximately 20 mm.

18. The component as claimed in claim 11, comprising:

a plurality of passages are arranged in the component in parallel and/or in series and at a distance from each other.

* * * * *